US011242499B2

(12) United States Patent
Piorkowski

(10) Patent No.: US 11,242,499 B2
(45) Date of Patent: Feb. 8, 2022

(54) USE OF GLYCOL ETHERS AND ALKYL ALCOHOL BLENDS TO CONTROL SURFACTANT COMPOSITION RHEOLOGY

(71) Applicant: Henkel IP & Holding GmbH, Duesseldorf (DE)

(72) Inventor: Daniel T. Piorkowski, Fairfield, CT (US)

(73) Assignee: Henkel IP & Holding GmbH, Duesseldorf (DE)

( * ) Notice: Subject to any disclaimer, the term of this patent is extended or adjusted under 35 U.S.C. 154(b) by 122 days.

(21) Appl. No.: 16/546,846

(22) Filed: Aug. 21, 2019

(65) Prior Publication Data

US 2021/0054308 A1 Feb. 25, 2021

(51) Int. Cl.

| | |
|---|---|
| ***C11D 1/00*** | (2006.01) |
| ***C11D 1/831*** | (2006.01) |
| ***C11D 1/14*** | (2006.01) |

(52) U.S. Cl.

CPC ..... *C11D 1/831* (2013.01); *C11D 1/146* (2013.01)

(58) Field of Classification Search

CPC ..... C11D 1/83; C11D 1/831; C11D 1/146; C11D 3/2006; C11D 3/20013

See application file for complete search history.

(56) References Cited

U.S. PATENT DOCUMENTS

| | | | | |
|---|---|---|---|---|
| 3,812,041 | A | 5/1974 | Inamorato | |
| 4,744,916 | A | 5/1988 | Adams | |
| 5,102,573 | A | 4/1992 | Han et al. | |
| 5,523,013 | A * | 6/1996 | Durbut | C11D 3/2086 510/235 |
| 6,482,792 | B2 | 11/2002 | Ip | |
| 6,566,317 | B2 | 5/2003 | Morris et al. | |
| 2004/0077519 | A1 | 4/2004 | Price et al. | |
| 2006/0094617 | A1 | 5/2006 | Price et al. | |

(Continued)

FOREIGN PATENT DOCUMENTS

| | | | |
|---|---|---|---|
| CA | 1293905 | C | 1/1992 |
| CN | 101210213 | A | 7/2008 |

(Continued)

OTHER PUBLICATIONS

Piorkowski, Daniel T., U.S. Appl. No. 16/231,309, "Use of Ethyleneoxy and Propyleneoxy Copolymer to Control Rheology of Unit Dose Detergent Pack", filed Dec. 21, 2018.

(Continued)

*Primary Examiner* — Necholus Ogden, Jr.
(74) *Attorney, Agent, or Firm* — Bojuan Deng

(57) ABSTRACT

A surfactant composition includes a surfactant component including an alcohol ethoxy sulfate having a $C_8$-$C_{20}$ backbone ethoxylated with from about 1 to about 10 moles of ethylene oxide and is present in an amount of from about 20 to about 80 weight percent actives. The surfactant composition also includes water present in a total amount of about 10 to about 35 weight percent. The surfactant composition further includes an alkyl alcohol present in an amount of from about 3 to about 10 weight percent. The surfactant composition also includes a glycol ether present in an amount of about 2 to about 20 weight percent. The surfactant composition has a viscosity of less than about 5,000 cps measured at 20° C.

20 Claims, 1 Drawing Sheet

(56) References Cited

U.S. PATENT DOCUMENTS

| | | | | |
|---|---|---|---|---|
| 2008/0119382 | A1* | 5/2008 | Diet | C11D 1/146<br>510/406 |
| 2015/0344821 | A1* | 12/2015 | Bettiol | C11D 1/143<br>510/237 |
| 2019/0119606 | A1* | 4/2019 | Bauer | B08B 3/003 |

FOREIGN PATENT DOCUMENTS

| | | | |
|---|---|---|---|
| CN | 106669537 | A | 5/2017 |
| GB | 2209342 | A | 5/1989 |
| WO | 2012154500 | A1 | 11/2012 |
| WO | 2015095824 | A1 | 6/2015 |

OTHER PUBLICATIONS

Piorkowski, Daniel T. et al., U.S. Appl. No. 16/231,232, "Use of Ionic Liquids to Control Rheology of Unit Dose Detergent Compositions," filed Dec. 21, 2018.

Piorkowski, Daniel T. et al., U.S. Appl. No. 16/231,269 entitled, "Use of Polyglycols to Control Rheology of Unit Dose Detergent Compositions," filed Dec. 21, 2018.

Piorkowski, Daniel T. et al., U.S. Appl. No. 16/231,298, "Use of Alkoxylated Polyamines to Control Rheology of Unit Dose Detergent Compositions," filed Dec. 21, 2018.

PCT Search Report PCT/US2020/047284 Completed: Nov. 25, 2020 dated Nov. 26, 2020 9 Pages.

* cited by examiner

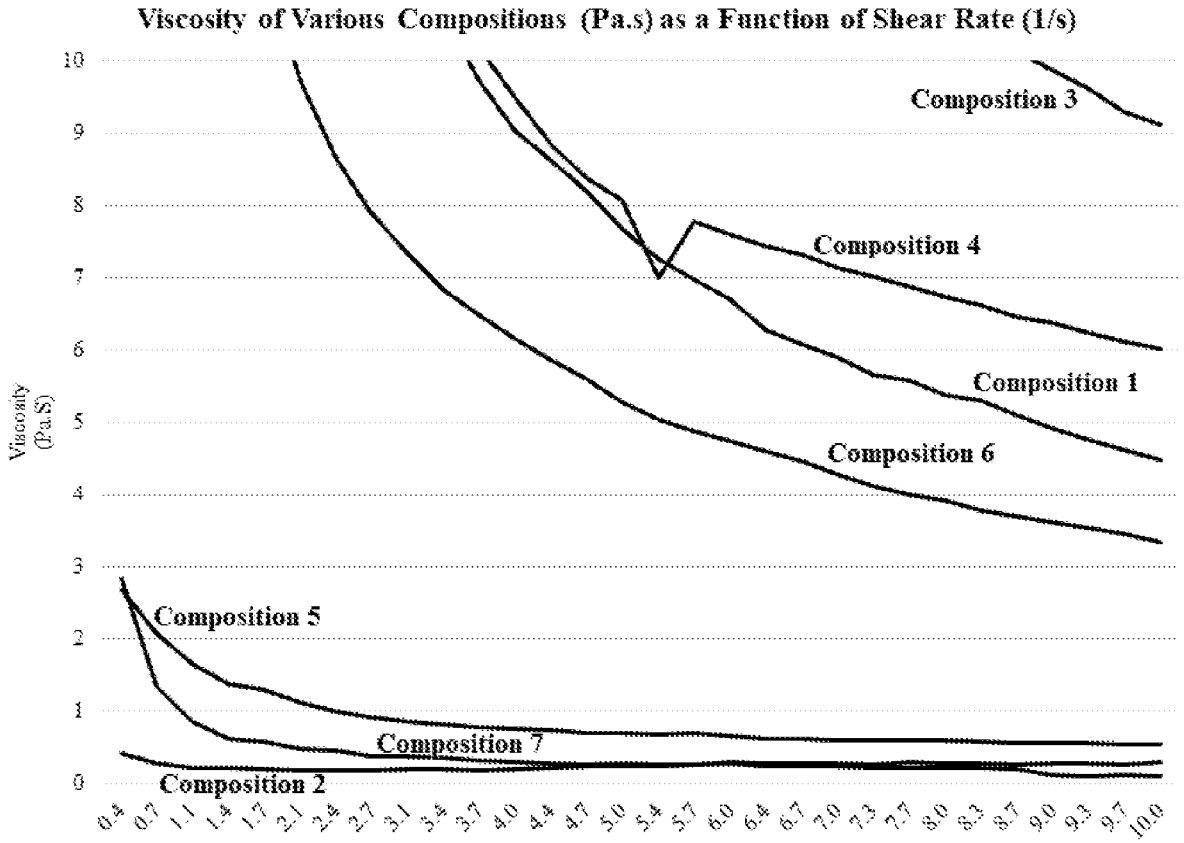
Viscosity of Various Compositions (Pa.s) as a Function of Shear Rate (1/s)
Viscosity (Pa.S)
10
9
8
7
6
5
4
3
2
1
0
Composition 3
Composition 4
Composition 1
Composition 6
Composition 5
Composition 7
Composition 2
0.4
0.7
1.1
1.4
1.7
2.1
2.4
2.7
3.1
3.4
3.7
4.0
4.4
4.7
5.0
5.4
5.7
6.0
6.4
6.7
7.0
7.3
7.7
8.0
8.3
8.7
9.0
9.3
9.7
10.0

USE OF GLYCOL ETHERS AND ALKYL ALCOHOL BLENDS TO CONTROL SURFACTANT COMPOSITION RHEOLOGY

FIELD OF THE INVENTION

The present disclosure generally relates to a surfactant composition and a method of controlling the rheology of the composition. More specifically, the disclosure relates to inclusion of a glycol ether in a surfactant composition including an alkyl alcohol and an alcohol ethoxy sulfate surfactant.

BACKGROUND OF THE INVENTION

Many current detergent compositions include surfactants, such as sodium laureth sulfate. However, these types of surfactants typically increase in viscosity upon dilution with water. For example, detergent compositions that that include sodium laureth sulfate are known to be potentially difficult to work with because of the tendency to increase in viscosity and form near solid masses that can be difficult to dissolve. For example, such detergent compositions can have viscosities upon dilution with water that approach and exceed 100 Pa·s when measured at a shear rate of 0.41 l/sec using commonly available rheometers. One commercially available product exhibits non-Newtonian characteristics and is difficult to handle due to its high viscosity of about 33 Pa·s when measured at a shear rate of 1.08 l/sec using commonly available rheometers.

If these surfactants increase in viscosity in unit dose packs, the compositions are not suitable for cleaning various surfaces and stains because the surfactants do not homogeneously disperse in water. Moreover, even if the surfactants undergo an increased viscosity phase and then break apart, their cleaning effectiveness is still reduced. Accordingly, there remains an opportunity for improvement. Furthermore, other desirable features and characteristics of the present disclosure will become apparent from the subsequent detailed description of the disclosure and the appended claims, taken in conjunction this background of the disclosure.

SUMMARY OF THE INVENTION

This disclosure provides a surfactant composition that includes a surfactant component including an alcohol ethoxy sulfate having a $C_8$-$C_{20}$ backbone that is ethoxylated with from about 1 to about 10 moles of ethylene oxide and is present in an amount of from about 20 to about 80 weight percent actives based on a total weight of said surfactant composition. The surfactant composition also includes water present in a total amount of about 10 to about 50 weight percent based on a total weight of the surfactant composition. The surfactant composition further includes an alkyl alcohol present in an amount of from about 3 to about 10 weight percent based on a total weight of the surfactant composition. The surfactant composition also includes a glycol ether present in a total amount of about 2 to about 20 weight percent based on a total weight of the surfactant composition. The surfactant composition has a viscosity of less than about 5,000 cps measured at 20° C.

This disclosure also provides a surfactant composition exhibiting approximate Newtonian behavior under shear. In this embodiment, the surfactant composition includes the surfactant component, the water, and the glycol ether described above. Moreover, in this embodiment, the surfactant composition includes ethanol as the alkyl alcohol. In this embodiment, the surfactant composition has a viscosity of less than about 1,500 cps measured at 20° C.

This disclosure further provides a method for modifying rheology of a surfactant composition. The method includes the steps of providing the surfactant component, providing the alkyl alcohol, and providing the glycol ether. The method also includes the step of combining the surfactant component, the alkyl alcohol, and the glycol ether to form the surfactant composition. Upon formation, the surfactant component is present in an amount of from about 20 to about 80 weight percent actives based on a total weight of the surfactant composition, the alkyl alcohol is present in an amount of from about 3 to about 10 weight percent based on a total weight of the surfactant composition, and the glycol ether is present in an amount of about 2 to about 20 weight percent based on a total weight of the surfactant composition. Moreover, upon combination, the surfactant composition includes water present in a total amount of about 10 to about 50 weight percent based on a total weight of the surfactant composition. In the method, the surfactant composition has a viscosity of less than about 5,000 cps measured at 20° C.

The surfactant composition exhibits superior and unexpected results. More specifically, the glycol ether surprisingly reduces the viscosity of the surfactant composition which allows for simple formulations to be produced, less alcohol to be used, less chemical waste to be generated, and decreased production costs to be realized. More specifically, the glycol ether allows less of the alcohol to be used which enables more efficient and effective material handling and final product batching. The inclusion of the glycol ether in the surfactant composition also creates a less expensive and more efficient method of introducing the glycol ether into a final detergent product without the need of a dedicated ingredient tank, which reduces production costs and complexities. Moreover, the glycol ether allows the surfactant composition to maintain a consistent low viscosity profile.

Without wishing to be bound by theory, it is believed that by incorporating the glycol ether as a rheology modifying agent, the surfactant composition shows a trend of changing the behavior of the fluids from non-Newtonian, when the rheology modifier is not added, to approximately Newtonian, when the rheology modifier is added. In other words, the present inventions provides a surfactant composition with Newtonian or approximately Newtonian behavior upon inclusion of the rheology modifying agent.

BRIEF DESCRIPTION OF THE DRAWINGS

The present disclosure will hereinafter be described in conjunction with the following FIGURES, wherein:

FIG. 1 is a line graph of Viscosity of Compositions 1-7 of the Examples as a Function of Shear Rate illustrating the non-Newtonian behavior of various comparative compositions of the disclosure and the approximate Newtonian behavior of various surfactant compositions including the rheology modifying agent of this disclosure when subjected to varying shear rates, as also set forth in the Examples.

DETAILED DESCRIPTION OF THE INVENTION

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to surfactant compositions may not be described in detail herein. Moreover, the various tasks and process steps described herein may be incorporated into a more comprehensive procedure or process having additional steps or functionality not described in detail herein. In particular, various steps in the manufacture of surfactant compositions are well-known and so, in the interest of brevity, many conventional steps will only be mentioned briefly herein or will be omitted entirely without providing the well-known process details.

In one aspect, the present disclosure provides a surfactant composition with a consistent, low viscosity profile. The surfactant composition may comprise a particular surfactant, water, an alkyl alcohol, and a particular glycol ether, as described in detail below. Of the components, the glycol ether is a rheology modifying agent. The surfactant composition may be used downstream to form a detergent composition, e.g. a detergent composition that is used in a unit dose pack detergent product.

In another aspect, the present disclosure provides a method for modifying rheology of a surfactant composition. The method includes the steps of providing the surfactant component, providing the alkyl alcohol, and providing the glycol ether. The method also includes the step of combining the surfactant component, the alkyl alcohol, and the glycol ether to form the surfactant composition. Upon formation, the surfactant component is present in an amount of from about 20 to about 80 weight percent actives based on a total weight of the surfactant composition, the alkyl alcohol is present in an amount of from about 3 to about 10 weight percent based on a total weight of the surfactant composition, and the glycol ether is present in an amount of about 2 to about 20 weight percent based on a total weight of the surfactant composition. Moreover, upon combination, the surfactant composition includes water present in a total amount of about 10 to about 50 weight percent based on a total weight of the surfactant composition. In the method, the surfactant composition has a modified and consistent low viscosity of less than about 5,000 cps measured at 20° C. For example, this viscosity can be measured using an AR2000-EX Rheometer at a shear rate of 1.08 l/s over 5 minutes at 20° C. with a geometry cone of 40 mm, 1:59:49 degree: min:sec, and a truncation gap of 52 microns.

It was unexpectedly discovered that, as a result of incorporating the rheology modifying agent, i.e., the glycol ether, the surfactant composition shows a trend of changing from a non-Newtonian fluid to a Newtonian, or approximately Newtonian, fluid. A Newtonian fluid is a fluid wherein the ratio between shear stress changes linearly in proportion to the stress to which it is exposed. This proportion is known as viscosity. A Newtonian fluid exhibits a consistent viscosity level. More specifically, Newtonian fluids also typically exhibit a commensurate, linear increase in shear stress with increases in shear rate, while non-Newtonian fluids exhibit a non-linear relationship between shear stress and shear rate. Various non-Newtonian fluids can exhibit shear thickening (i.e., an increase in viscosity with increased shear rates) or shear thinning (i.e., a decrease in viscosity with increased shear rate). Non-Newtonian fluids that exhibit shear thinning may have a yield point. The yield point is an oscillation stress at which steeper declines in viscosity are produced, as indicated by shear modulus (G') decline, with further increases in the oscillation stress beyond the yield point also producing the steeper decline in shear modulus. At oscillation stress below the yield point, changes in shear rate with stress have a minimal to no impact on the viscosity of the material. At oscillation stress above the yield point, the material begins to exhibit rapid viscosity decreases with increased levels of stress.

It was also unexpectedly discovered that incorporation of the rheology modifying agent in the surfactant composition, along with the alkyl alcohol, also lowers the viscosity of the surfactant composition as compared to when the rheology modifying agent and the alkyl alcohol is not added. The consistent, low viscosity profile is advantageous for downstream use in a detergent composition and/or unit dose detergent product.

Surfactant Composition

This disclosure provides the surfactant composition, first introduced above and hereinafter referred to as a composition. The composition may be, include, consist essentially of, or consist of, a surfactant component including an alcohol ethoxy sulfate, an alkyl alcohol, water, and a glycol ether, as each is described below, e.g. in any one or more of the amounts described in greater detail below.

In one embodiment, the composition comprises the surfactant component including an alcohol ethoxy sulfate, an alkyl alcohol, water, and the glycol ether.

In another embodiment, the composition consists essentially of the surfactant component including an alcohol ethoxy sulfate, an alkyl alcohol, water, and the glycol ether.

In still another embodiment, the composition consists of the surfactant component including an alcohol ethoxy sulfate, an alkyl alcohol, water, and the glycol ether.

In one embodiment, the composition comprises the surfactant component including an alcohol ethoxy sulfate and present in an amount of from about 20 to about 80 weight percent actives based on a total weight of the composition; water present in a total amount of from about 10 to about 50 weight percent based on a total weight of the composition; an alkyl alcohol present in an amount of from about 3 to about 10 weight percent based on a total weight of the composition, and a glycol ether present in an amount of about 2 to about 20 weight percent based on a total weight of the composition, each as described in greater detail below.

In another embodiment, the composition consists essentially of the surfactant component including an alcohol ethoxy sulfate and present in an amount of from about 20 to about 80 weight percent actives based on a total weight of the composition; water present in a total amount of from about 10 to about 50 weight percent based on a total weight of the composition; an alkyl alcohol present in an amount of from about 3 to about 10 weight percent based on a total weight of the composition, and a glycol ether present in an amount of about 2 to about 20 weight percent based on a total weight of the composition, each as described in greater detail below.

In still other embodiments, the composition may comprise, consist essentially of, or consist of, any combination of components described herein, in any amounts described herein.

In further embodiments, the composition is free of, or includes less than 1, 0.5, 0.1, 0.05, or 0.01, weight percent of, any one or more of the optional components or additives described below and/or those such as, but not limited to, cationic surfactants, amphoteric (zwitterionic surfactants), etc.

The composition of this disclosure is typically described as a surfactant composition because it includes more highly concentrated components than a typical "detergent" composition. For example, the surfactant composition can be described as a type of surfactant masterbatch or component that is then used to form a detergent or detergent composition in a downstream production process. The surfactant composition of this disclosure may be further diluted and/or combined with other components to form an eventual detergent composition, as would generally be defined in the art.

Surfactant Component

As first introduced above, the composition includes the surfactant component. The surfactant component can include a single surfactant or two or more surfactants. The surfactant component includes an alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various non-limiting embodiments, all values, both whole and fractional, between and including all of the above, are hereby expressly contemplated for use herein.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values, both whole and fractional, between and including all of the above, are hereby expressly contemplated for use herein.

The surfactant component is present in an amount of from about 20 to about 80, about 25 to about 75, about 30 to about 70, about 35 to about 65, about 40 to about 60, about 45 to about 55, about 45 to about 50, about 40 to about 45, or about 35 to about 45, weight percent actives based on a total weight of the composition. In other embodiments, the surfactant component is present in an amount of about 40, 41, 42, 43, 44, or 45, weight percent actives based on a total weight of the composition. In various non-limiting embodiments, all values, both whole and fractional, between and including all of the above, are hereby expressly contemplated for use herein.

The entire weight of the surfactant component may be the weight of the alcohol ethoxy sulfate itself without any additional surfactants included in this weight. Alternatively, other surfactants may be included in this weight percentage. In various non-limiting embodiments, all values, both whole and fractional, between and including all of the above, are hereby expressly contemplated for use herein.

Water:

Water is present in the composition in an amount of from about 10 to about 50 weight percent based on a total weight of the composition. In various embodiments, water is present in a total amount of from about 15 to about 45, about 20 to about 40, about 25 to about 35, about 25 to about 30, about 20 to about 50, about 25 to about 45, about 30 to about 40, or about 35 to about 40, weight percent based on a total weight of the composition. Typically, the terminology "total amount" refers to a total amount of water present in the composition from all components, i.e., not simply water added independently from, for example, the surfactant component and/or the glycol ether. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used. Alternatively, an independent source of water may be excluded.

Alkyl Alcohol:

The composition also includes an alkyl alcohol. The alkyl alcohol may be any alcohol that includes an alkyl group. For example, the alkyl group may include 1, 2, 3, 4, 5, 6, 7, 8, 9, 10, 11, 12, 13, 14, 15, 16, 17, 18, 19, 20, or more, carbon atoms. For example, the alkyl group may be methyl, ethyl, propyl, butyl, etc., such that the alcohol is methanol, ethanol, propanol, butanol, etc. Alternatively, the alkyl alcohol may include two or more such alcohols. In varying embodiments, the alkyl alcohol includes blends of higher carbon chain length alkyl alcohols such as C8-C12, C10-C14, C16-C18, alcohol, etc. Typically, the alkyl alcohol is ethanol. In various non-limiting embodiments, all values, both whole and fractional, between and including all of the above, are hereby expressly contemplated for use herein.

The alkyl alcohol is present in an amount of from about 3 to about 10 weight percent based on a total weight of the composition. In varying embodiments, the alkyl alcohol is present in an amount of about 4 to about 9, about 5 to about 8, about 6 to about 7, or 3, 4, 5, 6, 7, 8, 9, or 10, weight percent based on a total weight of the composition. In various non-limiting embodiments, all values, both whole and fractional, between and including all of the above, are hereby expressly contemplated for use herein.

Glycol Ether:

The composition also includes a glycol ether. The glycol ether is a liquid and may contribute to the excellent flowability and usability of the composition in various cleaning environments. The glycol ether is typically utilized as a rheology modifying agent.

The glycol ether is present in an amount of from about 2 to about 20 weight percent based on a total weight of the composition. In various embodiments, the glycol ether is present in an amount of from about 3 to about 19, about 4 to about 18, about 5 to about 17, about 6 to about 16, about 7 to about 15, about 8 to about 14, about 9 to about 13, about 10 to about 12, or about 11 to about 12, weight percent based on a total weight of the composition. In other embodiments, the glycol ether is present in an amount of about 12 to about 18, about 13 to about 17, about 14 to about 16, or about 15 to about 16, weight percent based on a total weight of the composition. In other embodiments, the glycol ether is present in an amount of about 2, 3, 4, 5, 6, 7, 8, 9, 10, 11, 12, 13, 14, 15, 16, 17, 18, 19, or 20, weight percent based on a total weight of the composition. In various non-limiting embodiments, all values, both whole and fractional, between and including all of the above, are hereby expressly contemplated for use herein.

The glycol ether may be a single glycol ether or may be a combination of glycol ethers. In other words, the glycol ether may be or include one or more individual glycol ethers, each independently as described herein or alternatively may be or include just one or more particular glycol ethers to the exclusion of one or more other glycol ethers.

In one embodiment, the glycol ether is further defined as the reaction product of an alcohol and from 1 to 3 moles of ethylene oxide, e.g. about 1, about 2, or about 3 moles of ethylene oxide. Alternatively, the glycol ether is further defined as the reaction product of an alcohol and from 1 to 3 moles of propylene oxide, e.g. about 1, about 2, or about 3 moles of propylene oxide. Alternatively, the glycol ether is further defined as the reaction product of an alcohol and from 1 to 3 moles of butylene oxide, e.g. about 1, about 2, or about 3 moles of butylene oxide. Even further, the glycol ether may be further defined as the reaction product of an alcohol and from 1 to 3 moles of a mixture of alkylene oxides, e.g. ethylene oxide, and/or propylene oxide, and/or butylene oxide, e.g. about 1, about 2, or about 3 moles of the mixture of alkylene oxides. In various non-limiting embodiments, all values, both whole and fractional, between and including all of the above, are hereby expressly contemplated for use herein.

In other embodiments, the alcohol may be any known in the art. For example, the alcohol may be chosen from methanol, ethanol, propanol, butanol, hexanol, and combinations thereof.

In one embodiment, the glycol ether is further defined as the reaction product of butanol and from 1 to 3 moles of ethylene oxide.

For example, the glycol ether may be further defined as diethylene glycol monobutyl ether.

In another embodiments, the glycol ether is further defined as ethylene glycol monobutyl ether.

In various embodiments, the glycol ether is chosen from ethylene glycol monomethyl ether (2-methoxyethanol, $CH_3OCH_2CH_2OH$); ethylene glycol monoethyl ether (2-ethoxyethanol, $CH_3CH_2OCH_2CH_2OH$); ethylene glycol monopropyl ether (2-propoxyethanol, $CH_3CH_2CH_2OCH_2CH_2OH$); ethylene glycol monoisopropyl ether (2-isopropoxyethanol, $(CH_3)_2CHOCH_2CH_2OH$); ethylene glycol monobutyl ether (2-butoxyethanol, $CH_3CH_2CH_2CH_2OCH_2CH_2OH$); ethylene glycol monophenyl ether (2-phenoxyethanol, $C_6H_5OCH_2CH_2OH$); ethylene glycol monobenzyl ether (2-benzyloxyethanol, $C_6H_5CH_2OCH_2CH_2OH$); propylene glycol methyl ether, (1-methoxy-2-propanol, $CH_3OCH_2CH(OH)CH_3$); diethylene glycol monomethyl ether (2-(2-methoxyethoxy)ethanol, methyl carbitol, $CH_3OCH_2CH_2OCH_2CH_2OH$); diethylene glycol monoethyl ether (2-(2-ethoxyethoxy)ethanol, carbitol cellosolve, $CH_3CH_2OCH_2CH_2OCH_2CH_2OH$); diethylene glycol mono-n-butyl ether (2-(2-butoxyethoxy)ethanol, butyl carbitol, $CH_3CH_2CH_2CH_2OCH_2CH_2OCH_2CH_2OH$); dipropyleneglycol methyl ether; or combinations thereof.

In still other embodiments, the glycol ether may be as set forth in Table 1 below:

TABLE 1

| Ethylene Oxide (mol) | Methanol | Ethanol | Propanol | Butanol | Hexanol |
|---|---|---|---|---|---|
| 1 | Ethylene glycol monomethyl ether | Ethylene glycol monoethyl ether | Ethylene glycol monopropyl ether | Ethylene glycol monobutyl ether | Ethylene glycol monohexyl ether |
| 2 | Diethylene glycol monomethyl ether | Diethylene glycol monoethyl ether | Diethylene glycol monopropyl ether | Diethylene glycol monobutyl ether | Diethylene glycol monohexyl ether |
| 3 | Triethylene glycol monomethyl ether | Triethylene glycol monoethyl ether | Triethylene glycol monopropyl ether | Triethylene glycol monobutyl ether | Triethylene glycol monohexyl ether |

In one embodiment, the glycol ether is formed from the reaction of n-butanol and one mole of ethylene oxide and is commonly known as ethylene glycol monobutyl ether or Butyl Cellosolve. In another embodiment, the glycol ether is formed from reaction of n-butanol and two moles of ethylene oxide and is commonly known as diethylene glycol monobutyl ether or Butyl Carbitol.

Weight Percents/Ratios of Various Components:

The surfactant component, alkyl alcohol, water, and glycol ether are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In various embodiments, the surfactant component is present in an amount of about 40, 41, 42, 43, 44, or 45, weight percent actives based on a total weight of the composition, and the alkyl alcohol (such as ethanol) is present in an amount of 5, 6, 7, 8, 9, 10, 11, or 12, weight percent based on a total weight of the composition. In further embodiments, the glycol ether is present in an amount of from about 12 to about 18, e.g. 12, 13, 14, 15, 16, 17, or 18, weight percent actives based on a total weight of the composition. In such embodiments, water may be present in an amount of from about 10 to about 50, e.g. about 10 to about 35, weight percent based on a total weight of the composition.

In other embodiments, a weight ratio of the actives of the surfactant component:alkyl alcohol:glycol ether is about 60:(2 to 8):(2 to 20). In other embodiments, a weight ratio of the actives of the surfactant component:alkyl alcohol: actives of the glycol ether is about 60:6:12. In one embodiment, the ratio is about 60:6:18.

In other embodiments, the surfactant component, such as sodium laureth sulfate ethoxylated with about 2 to about 4 moles of ethylene oxide, is a 70% actives, 30% water solution, the alkyl alcohol is ethanol, and the glycol ether is diethylene glycol monobutyl ether and/or ethylene glycol monobutyl ether. In related embodiments, a weight ratio of the surfactant component (including water and actives): ethanol:the glycol ether is about 60:6:(12-18). In similar embodiments, the surfactant component has a viscosity of less than about 2,000 cps measured at 20° C. This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In one embodiment, a weight ratio of the actives of the surfactant component:alkyl alcohol:glycol ether is about 60:(2 to 8):(2 to 20), wherein the surfactant is sodium laureth sulfate, wherein the alkyl alcohol is ethanol, wherein the glycol ether is diethylene glycol monobutyl ether, and wherein the viscosity is less than about 2,000 cps. This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In another embodiment, a weight ratio of the actives of the surfactant component:alkyl alcohol:glycol ether is about 60:6:12, wherein the surfactant is sodium laureth sulfate, wherein the alkyl alcohol is ethanol, wherein the glycol ether is diethylene glycol monobutyl ether, and wherein the viscosity is less than about 1,700 cps (e.g. less than about 1668 cps). This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In a further embodiment, a weight ratio of the actives of the surfactant component:alkyl alcohol:glycol ether is about 60:6:18, wherein the surfactant is sodium laureth sulfate, wherein the alkyl alcohol is ethanol, wherein the glycol ether is diethylene glycol monobutyl ether, and wherein the viscosity is less than about 900 cps (e.g. less than about 857 cps). This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In one embodiment, the surfactant component has a viscosity of less than about 2,000 cps measured at 20° C. This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In another embodiment, a weight ratio of alkyl alcohol: glycol ether is about (2 to 8):(2 to 20), wherein the alkyl alcohol is ethanol, wherein the glycol ether is diethylene glycol monobutyl ether, and wherein the viscosity is less than about 2,000 cps. This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In another embodiment, a weight ratio of alkyl alcohol: glycol ether is about 6:12, wherein the alkyl alcohol is ethanol, wherein the glycol ether is diethylene glycol monobutyl ether, and wherein the viscosity is less than about 1,700 cps (e.g. less than about 1668 cps). This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In a further embodiment, a weight ratio of alkyl alcohol: glycol ether is about 6:18, wherein the alkyl alcohol is ethanol, wherein the glycol ether is diethylene glycol monobutyl ether, and wherein the viscosity is less than about 900 cps (e.g. less than about 857 cps). This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns.

In a further embodiment, the alkyl alcohol is present in an amount of from about 3 to about 6 weight percent based on a total weight of the surfactant composition.

In an additional embodiment, the alkyl alcohol is ethanol and is present in an amount of from about 3 to about 6 weight percent based on a total weight of the surfactant composition.

In another embodiment, the alkyl alcohol is ethanol and wherein a weight ratio of the actives of the surfactant component:ethanol:actives of the glycol ether is about 60:(2 to 8):(2 to 20).

In still other embodiments, the weight ratio of the alkyl alcohol:actives of the glycol ether contributes to the superior and unexpected results associated with the instant disclosure. For example, the alkyl alcohol may be any described herein singularly or in combination with one another while the glycol ether may any described herein singularly or in combination with one another. In various non-limiting embodiments, the weight ratio of the alkyl alcohol:glycol ether is about (3 to 10):(2 to 20), e.g. (2 to 8):(2 to 20). For example, the first value may be about 3, 4, 5, 6, 7, 8, 9 or 10 or any fractional value therebetween. The second value may be about 2, 3, 4 . . . 18, 19, or 20, or any fractional value therebetween. In one embodiment, the weight ratio is about 6:(12 to 18). In another embodiment, the weight ratio is about 6:12. In a further embodiment, the weight ratio is about 6:18. These ratios may be considered and utilized independent of any amount of the actives of the surfactant component. Any and all weight ratios described in this specification may alternatively be utilized independently from the actives of the surfactant component.

In a further embodiment, the glycol ether is present in an amount of about 12 weight percent based on a total weight of the detergent composition and the viscosity of the detergent composition is less than about 1,700 cps. This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns. In a related embodiment, the glycol ether is butyl carbitol, which is also known as diethylene glycol mono-n-butyl ether or (2-(2-butoxyethoxy)ethanol or DEGMBE.

In a further embodiment, the glycol ether is present in an amount of about 18 weight percent based on a total weight of the detergent composition and the viscosity of the detergent composition is less than about 860 cps. This viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns. In a related embodiment, the glycol ether is butyl carbitol, which is also known as diethylene glycol mono-n-butyl ether or (2-(2-butoxyethoxy)ethanol or DEGMBE.

In a further embodiment, the glycol ether is present in an amount of about 12 weight percent based on a total weight of the detergent composition. In a related embodiment, the glycol ether is butyl carbitol, which is also known as diethylene glycol mono-n-butyl ether or (2-(2-butoxyethoxy)ethanol or DEGMBE.

In a further embodiment, the glycol ether is present in an amount of about 18 weight percent based on a total weight of the detergent composition. In a related embodiment, the glycol ether is butyl carbitol, which is also known as diethylene glycol mono-n-butyl ether or (2-(2-butoxyethoxy)ethanol or DEGMBE.

In a further embodiment, the glycol ether is present in an amount of from about 12 to about 18 parts by weight per 100 parts by weight of the detergent composition. In a related embodiment, the glycol ether is butyl carbitol, which is also known as diethylene glycol mono-n-butyl ether or (2-(2-butoxyethoxy)ethanol or DEGMBE.

In another embodiment, the glycol ether is present in an amount of from about 12 to about 12 parts by weight per 100 parts by weight of the detergent composition and a weight ratio of SLES:ethanol:glycol ether is 60:6:12 by total weight. A weight ratio by actives may be about 42:6:12. In a related embodiment, the glycol ether is butyl carbitol, which is also known as diethylene glycol mono-n-butyl ether or (2-(2-butoxyethoxy)ethanol or DEGMBE.

In another embodiments, the glycol ether is present in an amount of from about 12 to about 18 parts by weight per 100 parts by weight of the detergent composition and a weight ratio of SLES:ethanol:glycol ether is 60:6:18 by total weight. A weight ratio by actives may be about 42:6:18. In a related embodiment, the glycol ether is butyl carbitol, which is also known as diethylene glycol mono-n-butyl ether or (2-(2-butoxyethoxy)ethanol or DEGMBE.

In further related embodiments, any one or more of the aforementioned alcohol ethoxy sulfates may be sodium laureth sulfate ethoxylated with about 2 to about 4 moles of ethylene oxide.

In still other embodiments, the ratio of SLES:glycol ether is 60:12 by total weight or 60:18 by total weight. In a related embodiment, the glycol ether is butyl carbitol, which is also known as diethylene glycol mono-n-butyl ether or (2-(2-butoxyethoxy)ethanol or DEGMBE.

In further embodiments, the ratio of SLES:ethanol is 60:6 by total weight. In a related embodiment, the glycol ether is butyl carbitol, which is also known as diethylene glycol mono-n-butyl ether or (2-(2-butoxyethoxy)ethanol or DEGMBE.

In all of the aforementioned non-limiting embodiments, all values, both whole and fractional, between and including all of the above, are hereby expressly contemplated for use herein.

Physical Properties:

Typically, compositions that include alcohol ethoxy sulfates and water have viscosity issues. However, the composition of the instant disclosure has decreased viscosity as compared to what would otherwise be expected. For example, the composition of this disclosure has a viscosity of less than about 5,000, about 4,500, about 4,000, about 3,500, about 3,000, about 2,500, about 2,000, about 1,600, about 1,500, about 1,200, about 1,000, about 850, or about 750, cps measured at 20° C. Again, this viscosity can be measured using an AR2000-EX Rheometer at a shear rate of 1.08 l/s over 5 minutes at 20° C. with a geometry cone of 40 mm, 1:59:49 degree:min:sec, and a truncation gap of 52 microns. In various embodiments, the cone is part number 511406.901. However, the shear rate, time, temperature, geometry cone, values for degree:min:sec, and truncation gap may all vary and be chosen by one of skill in the art. For example, the shear rate may be measured as is set forth in the Examples and FIGURES. In various non-limiting embodiments, all values, both whole and fractional, between and including all of the above, are hereby expressly contemplated for use herein.

Although the viscosity of the composition is described above as being measured at 20° C., for example using an AR2000-EX Rheometer, the viscosity may be alternatively measured using other techniques. For example, the viscosity may be measured using a Brookfield viscometer and any one or more spindles, as is chosen by one of skill in the art. In various embodiments, the composition has one or more of the aforementioned viscosities measured using a DV2T Brookfield viscometer at 20 rpm and 70° F. using spindle LV02(62).

Typically, a surfactant component such as sodium laureth sulfate (e.g. 70% actives in 30% water) has a viscosity of about 32,000 cps measured at 20° C. This viscosity may be measured using an AR2000-EX Rheometer at a shear rate of 1.08 l/s over 5 minutes at 20° C. with a geometry cone of 40 mm, 1:59:49 degree:min:sec, and a truncation gap of 52 microns. This is too thick/viscous to be commercially useful. If such a surfactant component is diluted with ethanol in a weight ratio of about 60:12 of surfactant:ethanol, such a mixture typically has a viscosity of about 230 cps measured at 20° C. This viscosity may be measured using an AR2000-EX Rheometer at a shear rate of 1.08 l/s over 5 minutes at 20° C. with a geometry cone of 40 mm, 1:59:49 degree:min:sec, and a truncation gap of 52 microns. However, such a mixture requires additional shipping and handling protections due to the amount of ethanol included therein. Furthermore, if such a mixture is created with less ethanol, e.g. in a weight ratio of 60:6 of surfactant:ethanol, such a mixture typically has a viscosity of about 18,000 cps measured at 20° C. This viscosity may be measured using an AR2000-EX Rheometer at a shear rate of 1.08 l/s over 5 minutes at 20° C. with a geometry cone of 40 mm, 1:59:49 degree:min:sec, and a truncation gap of 52 microns. This is again too thick/viscous to be commercially useful. Moreover, if such a surfactant component is diluted with a glycol ether without ethanol in a weight ratio of about 60:12 of surfactant:glycol ether, such a mixture typically has a viscosity of about 40,000 cps measured at 20° C. This viscosity may be measured using an AR2000-EX Rheometer at a shear rate of 1.08 l/s over 5 minutes at 20° C. with a geometry cone of 40 mm, 1:59:49 degree:min:sec, and a truncation gap of 52 microns. This is also too thick/viscous to be commercially useful. Accordingly, the surfactant composition of this disclosure provides particularly special unexpected results associated with minimized viscosity when the surfactant component is combined with the alkyl alcohol (such as ethanol), water, and the glycol ether of this disclosure. This combination provides special and unexpected rheology controlling results that are superior to what would otherwise be expected by those of skill in the art.

In various embodiments, the glycol ether surprisingly reduces the viscosity of the surfactant composition which allows for simple formulations to be produced, less alcohol to be used, less chemical waste to be generated, and decreased production costs to be realized. More specifically, the glycol ether allows less of the alcohol to be used which enables more efficient and effective material handling and final product batching. The inclusion of the glycol ether in the surfactant composition also creates a less expensive and more efficient method of introducing the glycol ether into a final detergent product without the need of a dedicated ingredient tank, which reduces production costs and complexities. Moreover, the glycol ether allows the surfactant composition to maintain a consistent low viscosity profile.

Without wishing to be bound by theory, it is believed that by incorporating the glycol ether as a rheology modifying agent, the surfactant composition shows a trend of changing the behavior of the fluids from non-Newtonian, when the rheology modifier is not added, to approximately Newtonian, when the rheology modifier is added. In other words, the present inventions provides a surfactant composition with Newtonian or approximately Newtonian behavior upon inclusion of the rheology modifying agent.

Additional Embodiments

This disclosure also provides a surfactant composition exhibiting approximate Newtonian behavior. The terminology "approximate Newtonian behavior" is as is understood by those of skill in the art, wherein Newtonian behavior is as described above. The surfactant composition includes the surfactant composition, alkyl alcohol, water, and the glycol ether described above.

Method for Modifying Rheology of the Detergent Composition:

As first introduced above, this disclosure further provides a method for modifying rheology of the surfactant composition. The method includes the steps of providing the surfactant component, providing the alkyl alcohol, and providing the glycol ether. The method also includes the step of combining the surfactant component, the alkyl alcohol, and the glycol ether to form the surfactant composition. Upon formation, the surfactant component is present in an amount of from about 20 to about 80 weight percent actives based on a total weight of the surfactant composition, the alkyl alcohol is present in an amount of from about 3 to about 10 weight percent based on a total weight of the surfactant composition, and the glycol ether is present in an amount of about 2 to about 20 weight percent based on a total weight of the surfactant composition. Moreover, upon combination, the surfactant composition includes water present in a total amount of about 10 to about 50, e.g. about 10 to about 35, weight percent based on a total weight of the surfactant composition. In the method, the surfactant composition has a viscosity of less than about 5,000 cps measured at 20° C. This viscosity may be measured using an AR2000-EX Rheometer at a shear rate of 1.08 l/s over 5 minutes at 20° C. with a geometry cone of 40 mm, 1:59:49 degree:min:sec, and a truncation gap of 52 microns.

EXAMPLES

The following compositions are formulated and evaluated to determine viscosity.

Composition 1 (comparative) is sodium laureth sulfate (SLES) as a 70% by weight actives mixture in 30% by weight water supplied as Steol CS270 by Stepan. The weight ratio of SLES:ethanol:glycol ether is 100:0:0 by total weight.

Composition 2 (comparative) is 60 g of the aforementioned SLES (70% actives) combined with 12 g ethanol. The weight ratio of SLES:ethanol:glycol ether is 60:12:0 by total weight. The weight ratio by actives is 42:12:0.

Composition 3 (comparative) is 60 g of the aforementioned SLES (70% actives) combined with 12 g of the glycol ether. The weight ratio of SLES:ethanol:glycol ether is 60:0:12 by total weight. The weight ratio by actives is 42:0:12.

Composition 4 (comparative) is 60 g of the aforementioned SLES (70% actives) combined with 18 g of the glycol ether. The weight ratio of SLES:ethanol:glycol ether is 60:0:18 by total weight. The weight ratio by actives is 42:0:12.

Composition 5 (inventive) is 60 g of the aforementioned SLES (70% actives) combined with 6 g ethanol and 12 g of the glycol ether. The weight ratio of SLES:ethanol:glycol ether is 60:6:12 by total weight. The weight ratio by actives is 42:6:12.

Composition 6 (comparative) is 60 g of the aforementioned SLES (70% actives) combined with 6 g ethanol. The weight ratio of SLES:ethanol:glycol ether is 60:6:0 by total weight. The weight ratio by actives is 42:6:0.

Composition 7 (inventive) is 60 g of the aforementioned SLES (70% actives) combined with 6 g ethanol and 18 g of the glycol ether. The weight ratio of SLES:ethanol:glycol ether is 60:6:18 by total weight. The weight ratio by actives is 42:6:18.

The glycol ether is butyl carbitol, which is also known as diethylene glycol mono-n-butyl ether or (2-(2-butoxyethoxy)ethanol or DEGMBE.

More specifically, these Compositions are evaluated using an AR2000-EX Rheometer, with a test method of increasing the shear rate from 0.41 to 10 l/s over 5 minutes at 20° C. with a geometry cone of 40 mm, 1:59:49 (degree:min:sec), and a truncation gap of 52 microns (cone is part number 511406.901).

The measured viscosities are reported in Table 2 below and illustrated in FIG. 1 wherein Compositions 1, 2, 3, 4 and 6 (Comps. 1, 2, 3, 4, and 6) are comparative and Compositions 5 and 7 (Comps. 5 and 7) are inventive and represent non-limiting embodiments of this disclosure.

TABLE 2

| Shear Rate (1/s) | Viscosity (Pa.S) Comp. 1 | Comp. 2 | Comp. 3 | Comp. 4 | Comp. 5 | Comp. 6 | Comp. 7 |
|---|---|---|---|---|---|---|---|
| 0.41 | 95.51 | 0.4293 | 124.3 | 76.3 | 2.68 | 55.07 | 2.845 |
| 0.75 | 49.48 | 0.2936 | 59.4 | 38.14 | 2.092 | 28.73 | 1.345 |
| 1.08 | 32.98 | 0.2315 | 40.74 | 25.78 | 1.668 | 18.62 | 0.8572 |
| 1.41 | 24.73 | 0.2212 | 32.64 | 20.5 | 1.388 | 13.91 | 0.6315 |
| 1.73 | 19.84 | 0.1963 | 27.79 | 17.64 | 1.296 | 11.31 | 0.5775 |
| 2.06 | 16.66 | 0.1758 | 24.41 | 15.82 | 1.133 | 9.707 | 0.4828 |
| 2.39 | 14.55 | 0.1758 | 21.78 | 14.46 | 1.012 | 8.653 | 0.4557 |
| 2.72 | 12.92 | 0.1896 | 19.61 | 13.24 | 0.9268 | 7.903 | 0.3945 |
| 3.06 | 11.77 | 0.2012 | 18.11 | 12.1 | 0.8627 | 7.339 | 0.3915 |
| 3.39 | 10.64 | 0.1954 | 16.92 | 11.06 | 0.8237 | 6.842 | 0.3556 |
| 3.71 | 9.708 | 0.1941 | 15.81 | 10.18 | 0.7792 | 6.469 | 0.3296 |
| 4.05 | 9.031 | 0.2076 | 15.09 | 9.488 | 0.7606 | 6.157 | 0.2982 |
| 4.37 | 8.616 | 0.2203 | 14.61 | 8.837 | 0.7395 | 5.86 | 0.2883 |
| 4.71 | 8.195 | 0.2458 | 14.03 | 8.373 | 0.7101 | 5.591 | 0.2628 |
| 5.03 | 7.684 | 0.2526 | 13.56 | 8.068 | 0.6959 | 5.284 | 0.2877 |
| 5.37 | 7.263 | 0.2496 | 13.06 | 7.000 | 0.6849 | 5.039 | 0.2723 |
| 5.70 | 6.97 | 0.2744 | 12.62 | 7.772 | 0.6985 | 4.883 | 0.2698 |
| 6.03 | 6.687 | 0.2959 | 12.35 | 7.595 | 0.6557 | 4.733 | 0.2759 |
| 6.36 | 6.276 | 0.2935 | 11.96 | 7.439 | 0.6307 | 4.603 | 0.2532 |
| 6.68 | 6.086 | 0.2904 | 11.52 | 7.314 | 0.6198 | 4.463 | 0.2502 |
| 7.02 | 5.888 | 0.2798 | 11.36 | 7.145 | 0.6069 | 4.273 | 0.2428 |
| 7.35 | 5.652 | 0.2722 | 11.12 | 7.022 | 0.6045 | 4.125 | 0.2226 |
| 7.68 | 5.586 | 0.3064 | 10.89 | 6.877 | 0.6126 | 4.008 | 0.2258 |
| 8.01 | 5.383 | 0.2869 | 10.68 | 6.728 | 0.6062 | 3.917 | 0.2274 |
| 8.34 | 5.295 | 0.2826 | 10.47 | 6.613 | 0.591 | 3.788 | 0.2186 |
| 8.67 | 5.093 | 0.2664 | 10.14 | 6.463 | 0.5627 | 3.698 | 0.196 |
| 8.99 | 4.923 | 0.2813 | 9.868 | 6.368 | 0.5622 | 3.611 | 0.1321 |
| 9.32 | 4.756 | 0.2756 | 9.609 | 6.23 | 0.565 | 3.534 | 0.1135 |
| 9.66 | 4.613 | 0.2668 | 9.293 | 6.11 | 0.5513 | 3.456 | 0.1241 |
| 9.99 | 4.483 | 0.2953 | 9.116 | 6.019 | 0.5503 | 3.346 | 0.1145 |

As shown in the data above, the addition of ethanol significantly reduces the rheology of SLES when the ratio is 60 parts SLES Blend A to 12 parts ethanol. This is represented by Composition 2. However, inclusion of this amount of ethanol requires that additional shipping and handling precautions be taken which increases commercial costs. Therefore, this composition is not commercially efficient.

When the ratio is 60 parts SLES Blend A to 6 parts Ethanol represented by Composition 6, the viscosity at a shear rate of 1.08 l/s is reduced from about 32,980 cP (Composition 1) to about 18,620 cP (Composition 6). This viscosity is still too high to be commercially useable and efficient.

When an additional 12 parts of the glycol ether is utilized, represented by Composition 4, the viscosity drops from about 18,620 cP (Composition 6) to about 1668 cP (Composition 5). As a benchmark, a currently available commercial product has a viscosity of about 2,400 cP measured using an AR2000-EX Rheometer at a shear rate of 1.08 l/s over 5 minutes at 20° C. with a geometry cone of 40 mm, 1:59:49 degree:min:sec, and a truncation gap of 52 microns. Accordingly, Composition 5 represents an excellent performing product.

When 18 total parts of the glycol ether is utilized, represented by Composition 7, the viscosity drops from about 18,620 cP (Composition 6) to about 857 cP (Composition 7). Again, as compared to the aforementioned commercial benchmark, Composition 7 also represents an excellent performing product.

Therefore, the data associated with Compositions 3 and 6, shows that a blend of 60 parts (70% actives) SLES and 12 parts of the glycol ether (Composition 3), without ethanol, and 60 parts (70% actives) SLES and 6 parts ethanol (Composition 6), without the glycol ether, are each not as effective at reducing viscosity as a blend of 60 parts (70% actives) SLES and 12 parts glycol ether and 6 parts ethanol (Composition 5) or as a blend of 60 parts (70% actives) SLES and 18 parts glycol ether and 6 parts ethanol (Composition 7).

The data set forth above also demonstrates that comparative Compositions 1, 3, and 6 behave as non-Newtonian fluids, as evidenced by the viscosity measurements set forth in Table 2. Even with the addition of 6 g of ethanol, Composition 6 still acts as a non-Newtonian fluid. Only addition of 12 g of ethanol allows Formula 2 to behave in an approximately non-Newtonian fashion. Accordingly, one of skill in the art would not expect that using half the amount of ethanol, i.e., 6 g of ethanol, such as in Compositions 5 and 7, would allow these compositions to behave in an approximately non-Newtonian fashion. Again, this is evidenced by the viscosity measurements set forth in Table 2.

In sum, one of skill in the art would expect that the combination of the ethanol and the glycol ether would not significantly reduce the viscosity of the compositions. This is especially true in view of the comparison of comparative Compositions 2 and 4 with inventive Compositions 5 and 7. Comparative Compositions demonstrate that it requires about 12 g of ethanol to reduce the viscosity to useable levels. However, inventive Compositions 5 and 7 show that through use of the glycol ether, the viscosities of the Compositions are surprisingly reduced using only 6 g of ethanol. This is wholly unexpected. Moreover, and as explained above, it is also unexpected that use of the glycol ether would allow the Compositions to behave in an approximately Newtonian manner thereby allowing for easier preparation, handling, and shipping of not only these Compositions but also of downstream compositions, such as detergent compositions.

This data also shows that it was found that the addition of the glycol ether into sodium laureth sulfate can reduce viscosity, enabling much easier handling. It was also found that blends of the glycol ether and ethanol in sodium laureth sulfate can reduce the viscosity down to about 850 cP or about 1700 cP when measured using an AR2000-EX Rheometer at a shear rate of 1.08 l/s over 5 minutes at 20° C. with a geometry cone of 40 mm, 1:59:49 degree:min:sec, and a truncation gap of 52 microns. This combination utilizes about half of the ethanol as comparative composition. For these reasons, the glycol ether utilized herein can reduce the amount of ethanol needed to handle sodium laureth sulfate at commercial facilities thereby enabling safer material handling and final product batching. Also, the glycol ether can be introduced into downstream products without the need of a dedicated ingredient tank because it can be introduced with the sodium laureth sulfate. Without intending to be bound by any theory, it is also believed that this glycol ether may be particularly suitable for enhancing pac haptics and reducing water migration.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A surfactant composition comprising:

A. sodium laureth sulfate present in an amount of from about 20 to about 80 weight percent actives based on a total weight of said surfactant composition;

B. water present in a total amount of about 10 to about 50 weight percent based on a total weight of said surfactant composition;

C. ethanol present in an amount of from about 3 to about 10 weight percent based on a total weight of said surfactant composition; and D. diethylene glycol mono-n-butyl ether present in a total amount of about 2 to about 20 weight percent based on a total weight of said surfactant composition, wherein the ethanol and the diethylene glycol mono-n-butyl ether are present in a weight ratio of from 1:2 to 1:3, and wherein said surfactant composition has a viscosity of less than about 1,700 cps measured using an AR2000-EX Rheometer at a shear rate of 1.08 l/s at 20° C. with a geometry cone of 40 mm, 1:59:49 (degree:min:sec), and a truncation gap of 52 microns.

2. The surfactant composition of claim 1 wherein a weight ratio of said actives of said sodium laureth sulfate:ethanol: diethylene glycol mono-n-butyl ether is about 60(6):(12 to 18).

3. The surfactant composition of claim 1 wherein a weight ratio of said actives of said sodium laureth sulfate:ethanol: diethylene glycol mono-n-butyl ether is about 60:6:12.

4. The surfactant composition of claim 1 wherein a weight ratio of said actives of said sodium laureth sulfate:ethanol: diethylene glycol mono-n-butyl ether is about 60:6:18.

5. The surfactant composition of claim 1 wherein a weight ratio of said ethanol:diethylene glycol mono-n-butyl ether is about 6:12.

6. The surfactant composition of claim 1 wherein a weight ratio of said ethanol:diethylene glycol mono-n-butyl ether is about 6:18.

7. The surfactant composition of claim 1 wherein a weight ratio of said actives of said sodium laureth sulfate:ethanol: diethylene glycol mono-n-butyl ether is about 60:6:18 and wherein said viscosity is less than about 900 cps.

8. The surfactant composition of claim 1 wherein said diethylene glycol mono-n-butyl ether is present in an amount of from about 12 to about 18 weight percent based on a total weight of said surfactant composition.

9. The surfactant composition of claim 1 wherein said diethylene glycol mono-n-butyl ether is present in an amount of about 12 weight percent based on a total weight of said surfactant composition.

10. The surfactant composition of claim 1 wherein said diethylene glycol mono-n-butyl ether is present in an amount of about 18 weight percent actives based on a total weight of said surfactant composition.

11. A surfactant composition consisting essentially of:

A. sodium laureth sulfate present in an amount of from about 20 to about 80 weight percent actives based on a total weight of said surfactant composition;

B. water present in a total amount of about 10 to about 35 weight percent based on a total weight of said surfactant composition;

C. ethanol present in an amount of from about 3 to about 10 weight percent based on a total weight of said surfactant composition; and D. diethylene glycol mono-n-butyl ether present in a total amount of about 2 to about 20 weight percent based on a total weight of said surfactant composition, wherein the ethanol and the diethylene glycol mono-n-butyl ether are present in a weight ratio of from 1:2 to 1:3, wherein said surfactant composition has a viscosity of less than about 1,700 cps measured using an AR2000-EX Rheometer at a shear rate of 1.08 l/s at 20° C. with a geometry cone of 40 mm, 1:59:49 (degree:min:sec), and a truncation gap of 52 microns, and wherein said surfactant composition exhibits approximate Newtonian behavior under shear.

12. A method for modifying rheology of a surfactant composition, said method comprising the steps of:

providing sodium laureth sulfate;

providing ethanol;

providing diethylene glycol mono-n-butyl ether; and combining the sodium laureth sulfate, the ethanol, and the diethylene glycol mono-n-butyl ether to form the surfactant composition, wherein the sodium laureth sulfate is present in an amount of from about 20 to about 80 weight percent actives based on a total weight of the surfactant composition, wherein the ethanol is present in an amount of from about 3 to about 10 weight percent based on a total weight of the surfactant composition, wherein the diethylene glycol mono-n-butyl ether is present in an amount of about 2 to about 20 weight percent based on a total weight of the surfactant composition, wherein the surfactant composition comprises water present in a total amount of about 10 to about 50 weight percent based on a total weight of the surfactant composition and wherein the ethanol and the diethylene glycol mono-n-butyl ether are present in a weight ratio of from 1:2 to 1:3, and wherein the surfactant composition has a viscosity of less than about 1,700 cps measured using an AR2000-EX Rheometer at a shear rate of 1.08 l/s at 20° C. with a geometry cone of 40 mm, 1:59:49 (degree:min:sec), and a truncation gap of 52 microns.

13. The method of claim 12 wherein a weight ratio of the actives of the sodium laureth sulfate:ethanol:diethylene glycol mono-n-butyl ether is about 60:6:(12 to 18).

14. The method of claim 12 wherein a weight ratio of the actives of the sodium laureth sulfate:ethanol:diethylene glycol mono-n-butyl ether is about 60:6:12.

15. The method of claim 12 wherein a weight ratio of the actives of the sodium laureth sulfate:ethanol:diethylene glycol mono-n-butyl ether is about 60:6:18.

16. The method of claim 12 wherein a weight ratio of the ethanol:diethylene glycol mono-n-butyl ether is about 6:12.

17. The method of claim 12 wherein a weight ratio of the ethanol:diethylene glycol mono-n-butyl ether is about 6:18.

18. The method of claim 12 wherein a weight ratio of the actives of the sodium laureth sulfate:ethanol:diethylene glycol mono-n-butyl ether is about 60:6:18 and wherein the viscosity is less than about 900 cps.

19. The method of claim 12 wherein the diethylene glycol mono-n-butyl ether is present in an amount of from about 12 to about 18 weight percent based on a total weight of the surfactant composition.

20. The method of claim 12 wherein the diethylene glycol mono-n-butyl ether is present in an amount of about 12 or 18 weight percent based on a total weight of the surfactant composition.

* * * * *